US007276678B2

(12) United States Patent
Kim et al.

(10) Patent No.: US 7,276,678 B2
(45) Date of Patent: Oct. 2, 2007

(54) TURNTABLE DEVICE OF MICROWAVE OVEN

(75) Inventors: Jong-Sik Kim, Gyeonggi-Do (KR); Yang-Kyeong Kim, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/292,087

(22) Filed: Dec. 2, 2005

(65) Prior Publication Data

US 2006/0151491 A1 Jul. 13, 2006

(30) Foreign Application Priority Data

Jan. 4, 2005 (KR) ..... 10-2005-0000525

(51) Int. Cl.
*H05B 1/00* (2006.01)
*H05B 3/00* (2006.01)
*H05B 11/00* (2006.01)

(52) U.S. Cl. ..... 219/754; 126/338

(58) Field of Classification Search ..... 219/754, 219/745, 753, 752, 678; 126/338
See application file for complete search history.

(56) References Cited

U.S. PATENT DOCUMENTS 4,121,078 A 10/1978 Takano et al.
4,424,431 A 1/1984 Gurubatham
4,757,173 A 7/1988 Park et al.
6,452,143 B1 * 9/2002 Choi ..... 219/753
7,053,349 B2 * 5/2006 Jeong ..... 219/752
2002/0190062 A1 * 12/2002 Choi ..... 219/754
2003/0146211 A1 * 8/2003 Kang et al. ..... 219/754
2005/0016998 A1 * 1/2005 Choi ..... 219/754

FOREIGN PATENT DOCUMENTS

EP 1 272 009 A 1/2003
JP 2001-1319770 A 11/2001

* cited by examiner

*Primary Examiner*—Daniel Robinson
(74) *Attorney, Agent, or Firm*—Birch, Stewart, Kolasch & Birch, LLP

(57) ABSTRACT

A turntable device of a microwave oven including: a motor mounted at a lower portion of a cabinet; an arm connected with a rotational shaft of the motor so as to be rotatably moved and having first and second rollers at an end thereof; a first tray disposed to be linearly moved on the bottom of the cabinet and having a slot into which the first roller is inserted; and a second tray disposed to be rotatable on an upper surface of the first tray and having a guide rail into which the second roller is inserted. A heating target received in the cabinet can be rotatably, linearly and reciprocally moved so that the cooking target can be quickly and uniformly heated. In addition, because a relative velocity difference between the first and second rollers does not occur, the first and second trays are prevented from being released.

20 Claims, 6 Drawing Sheets

TURNTABLE DEVICE OF MICROWAVE OVEN

BACKGROUND OF THE INVENTION

1. Field of the Invention

The present invention relates to a turntable device of a microwave oven and, more particularly, to a turntable device of a microwave oven capable of uniformly heating food items by making the food item received in a cabinet rotated and linearly and reciprocally moved.

2. Description of the Background Art

FIG. 1 is a perspective view of a microwave oven in accordance with a conventional art and FIG. 2 is a sectional view of a turntable device of the microwave oven in accordance with the conventional art.

The conventional microwave oven includes a cabinet 110 having a cavity 102 in which a food item is received, a magnetron 104 installed at one side in the cabinet 110 and generating microwave supplied into the cavity 102, a high voltage generator 106 for supplying a high voltage to the magnetron 104, and a turntable 108 installed to be rotated and movable linearly and reciprocally on the bottom surface of the cabinet 110, on which the foot item is placed.

At an upper portion, there are provided a waveguide 112 for guiding microwave generated from the magnetron 104 to the cavity 102, and a stirrer fan 116 for uniformly irradiating the microwave emitted from the waveguide 112 to the cavity 102.

The turntable 108 includes a tray 120 rotatably disposed on the bottom of the cabinet 110, a rotator ring 122 disposed between the tray 120 and the bottom surface of the cabinet 110 and rotatably supporting the tray 120, and a motor 124 installed at a lower side of the cabinet 110 and having a rotational shaft connected with the tray 120 to rotate the tray 120.

In the turntable 108 of the conventional microwave oven, when the motor 124 is driven, the tray 120 is rotatably moved. Then, the food item placed on the tray 120 is also rotated and heated by microwave.

However, the turntable device of the conventional microwave oven makes only the rotational movement, the food item cannot be uniformly heated.

BRIEF DESCRIPTION OF THE INVENTION

Therefore, one object of the present invention is to provide a microwave oven capable of uniformly heating a heating target by having a linearly and reciprocally moving first tray and a rotationally moving second tray in order to rotate the heating target as well as linearly and reciprocally move it.

Another object of the present invention is to provide a microwave oven capable of preventing a tray from being released by preventing generation of a relative speed difference between the linearly and reciprocally moving first tray and the rotatably moving second tray.

To achieve these and other advantages and in accordance with the purpose of the present invention, as embodied and broadly described herein, there is provided a turntable device of a microwave oven including: a motor mounted at a lower portion of a cabinet; an arm connected with a rotational shaft of the motor so as to be rotatably moved and having first and second rollers at an end thereof; a first tray disposed to be linearly moved on the bottom of the cabinet and having a slot into which the first roller is inserted; and a second tray disposed to be rotatable on an upper surface of the first tray and having a guide rail into which the second roller is inserted.

A rotate ring is disposed between the first and second trays in order to rotatably support the second tray.

The arm is disposed in a space between the first and second trays and includes a first roller support for rotatably supporting the first roller at a lower surface of one end portion thereof and a second roller support rotatably supporting the second roller at an upper surface thereof.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

A turntable device of a microwave oven in accordance with the present invention will now be described with reference to the accompanying drawings.

Figure 1:
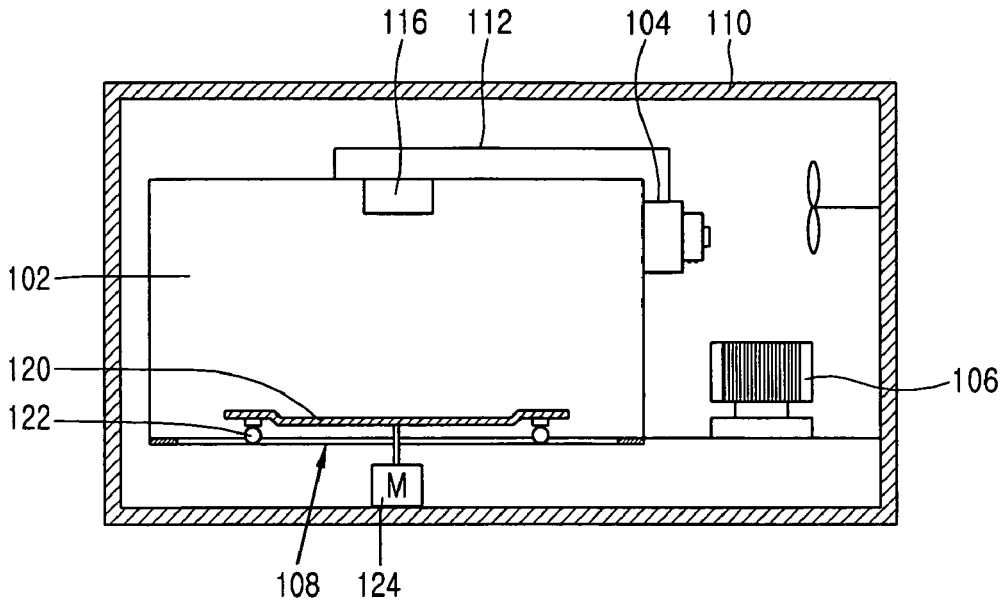
FIG. 1 CONVENTIONAL ART
FIG. 1 is a sectional view of a microwave oven in accordance with a conventional art.
Figure 2:
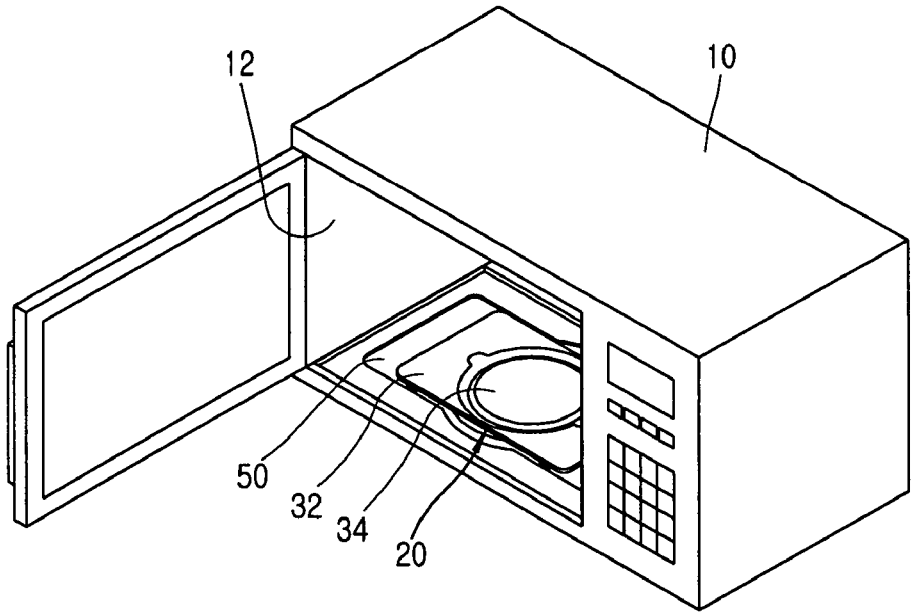
FIG. 2 is a perspective view of a microwave oven in accordance with the present invention.
Figure 3:
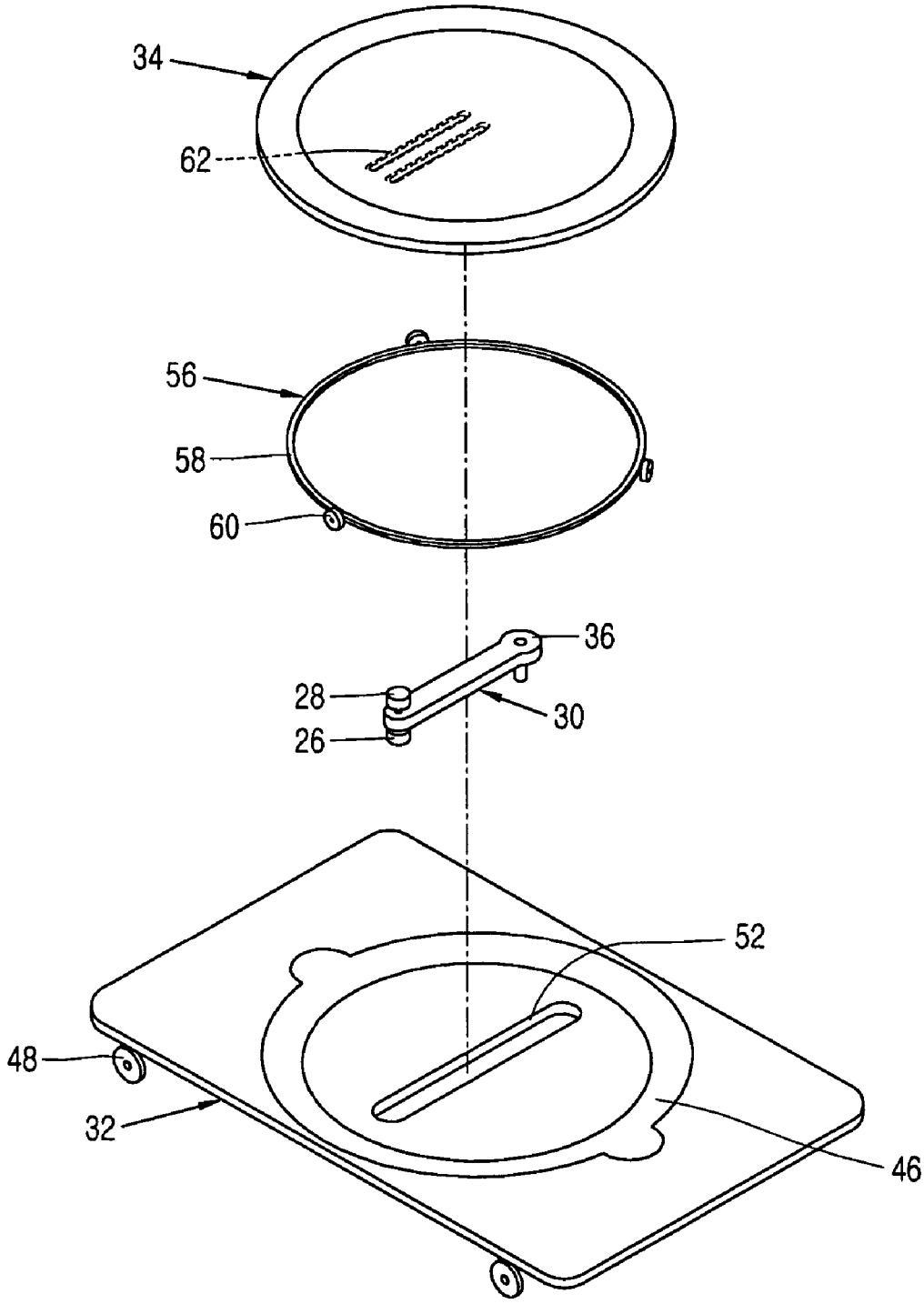
FIG. 3 is an exploded perspective view of a turntable device of a microwave oven in accordance with the present invention.
Figure 4:
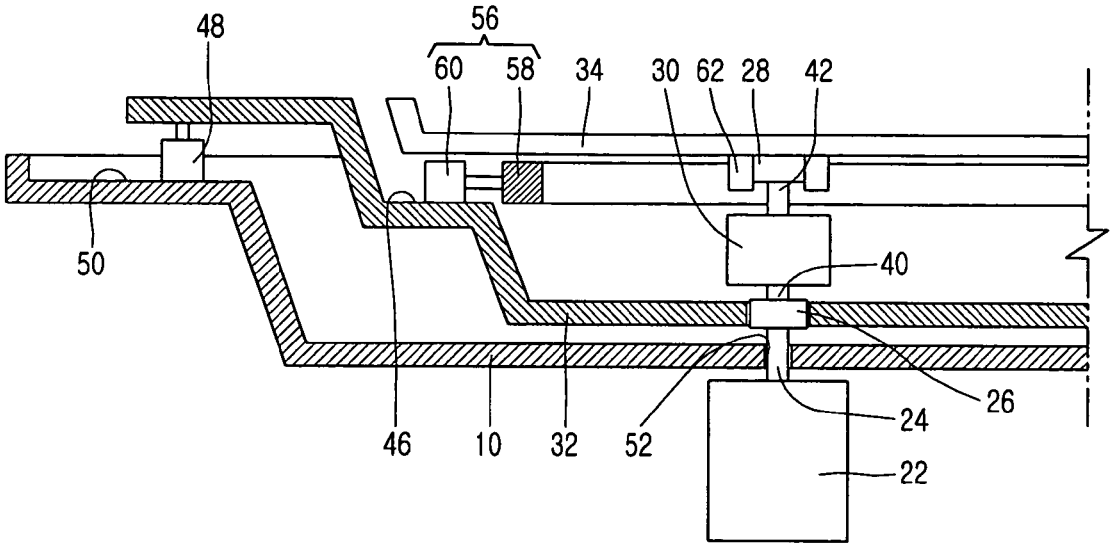
FIG. 4 is a sectional view of the turntable device of the microwave oven in accordance with the present invention.

FIG. 2 is a perspective view of a microwave oven in accordance with the present invention, FIG. 3 is an exploded perspective view of a turntable device of a microwave oven in accordance with the present invention, and FIG. 4 is a sectional view of the turntable device of the microwave oven in accordance with the present invention.

The microwave oven in accordance with the present invention includes a cabinet 10 having a cavity 12 in which a food item is received, a magnetron (not shown) installed at one side in the cabinet 10 and generating microwave supplied to the cavity 12, a high voltage generator (not shown) for generating a high voltage to be supplied to the magnetron, and a turntable device 20 installed to be rotated and linearly moved on the bottom surface of the cabinet 10, on which the food item is placed.

The turntable device 20 includes a motor 22 mounted at a lower side of the cabinet 10 and generating rotational force, an arm 30 connected with a rotational shaft 24 of the motor 22 and having first and second rollers 26 and 28 rotatably mounted at both end portions thereof, a first tray 32 disposed to be linearly moved in a left/right direction on the bottom surface of the cabinet 10 and linearly and reciprocally moved by the first roller 26 of the arm 30, and a second tray 34 rotatably disposed at an upper surface of the first tray 32 and rotatably moved by the second roller 28 of the arm 30.

Figure 5:
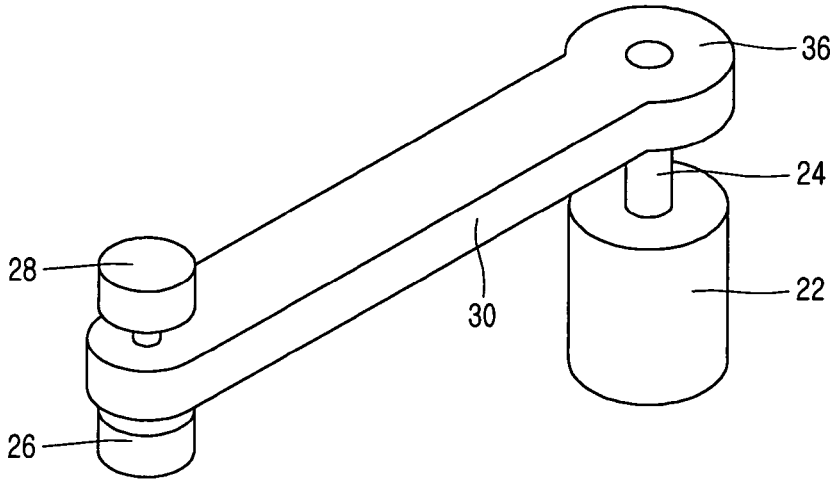
FIG. 5 is a perspective view of an arm of the turntable device of the microwave oven in accordance with the present invention.

As shown in FIG. 5, the arm 30 is disposed in a space between the first tray 32 and the second tray 34 and includes a rotational shaft connection part 36 formed at one end portion thereof. A first roller support 40 at which the first roller 26 is rotatably supported is formed at a lower surface of the other end portion, and a second roller support 42 at which the second roller 28 is rotatably supported is formed at a lower surface thereof.

The first roller support 40 and the second roller support 42 are formed on the same straight line, so that when the arm 30 is rotated, the first and second rollers 26 and 28 are rotated at the same rotational speed, preventing generation of a relative speed difference between the two rollers 26 and 28. Thus, the first tray 32 and the second tray 34 are prevented from being released due to a relative angular velocity between the first and second rollers 26 and 28.

Figure 6:
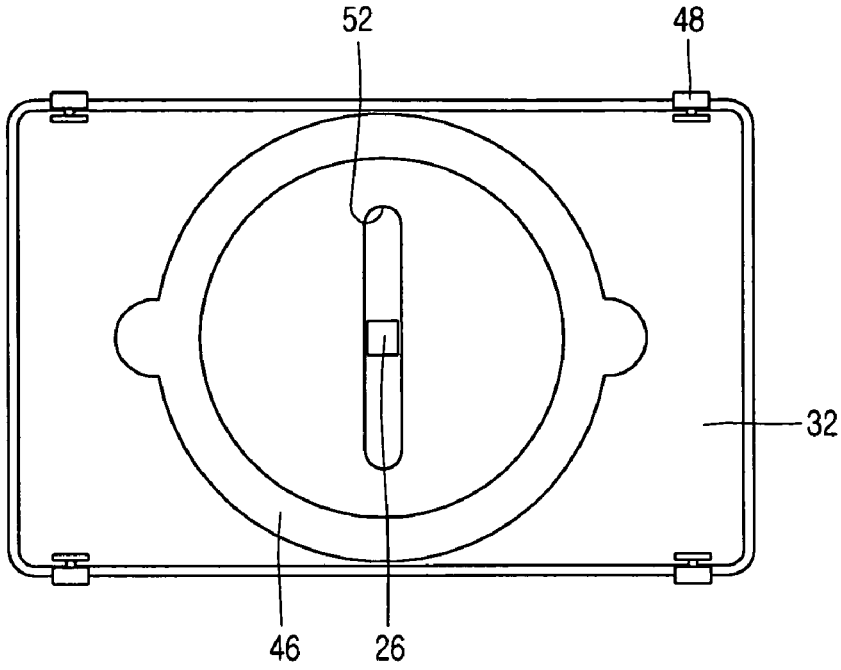
FIG. 6 is a bottom view of a first tray of the turntable device in accordance with the present invention.

As shown in FIG. 6, the first tray 32 is formed as a rectangular plate body, and a circular concave mounting unit 46 on which the second tray 34 is rotatably disposed is formed at its upper portion. A plurality of rollers 48 are mounted at a corner portion of the lower surface thereof and rollingly moved on the bottom surface of the cabinet 10. A guide groove 50 is formed on the bottom surface of the cabinet 10 to guide the rollers 48 to be linearly and reciprocally moved.

A slot 52 is formed at the first tray 32, in which the first roller 26 mounted at the arm 30 is inserted and linearly moved. The slot 52 is formed to penetrate the center of the first tray 32 and formed in forward/backward directions of the first tray 32. The slot 52 has a larger width than that of the first roller 26 so that the first roller 26 can be inserted and moved, and has a length twice that of the arm 30.

When the arm 30 is rotatably moved by the motor 22, the first roller 26 mounted at the end portion of the arm 30 is linearly and reciprocally moved along the slot 52, and accordingly, the first tray 32 is linearly and reciprocally moved in the left/right directions along the guide groove 50.

A rotator ring 56 for rotatably supporting the second tray 34 is disposed on the mounting part 46 of the first tray 32. The rotator ring 56 includes a support 58 having a circular annular shape and a plurality of rollers 60 formed at equal intervals in a circumferential direction of the support 58 and rollingly moved on the mounting part 46.

Figure 7:
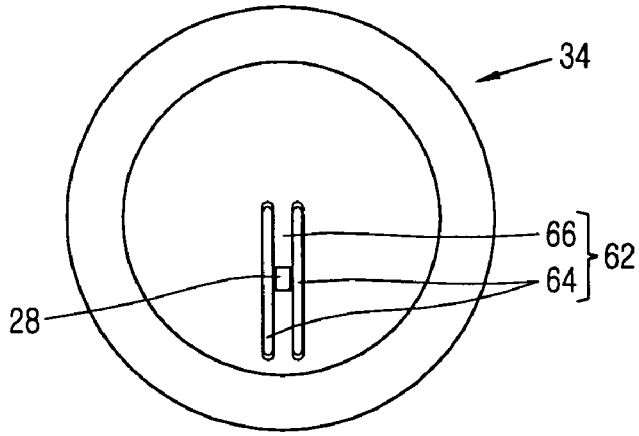
FIG. 7 is a bottom view of a second tray of the turntable device in accordance with the present invention.

With reference to FIG. 7, the second tray 34 has a disk type and is mounted on the upper surface of the rotator ring 56, and a guide rail 62 in which the second roller 28 is inserted and moved therealong is formed in its radial direction.

The guide rail 62 includes a pair of protrusions 64 protruded in the radial direction at a lower surface of the second tray 34, and a recess 66 formed between the pair of protrusions 64, in which the second roller 28 is inserted and linearly moved.

When the arm 30 is rotated and the second roller 28 is moved along the guide rail 62, the second tray 34 is rotatably moved on the upper surface of the first tray 32.

The operation of the turntable in accordance with the present invention will now be described.

FIGS. 8 to 11 show operational states of the turntable device of the microwave oven in accordance with the present invention.

Figure 8:
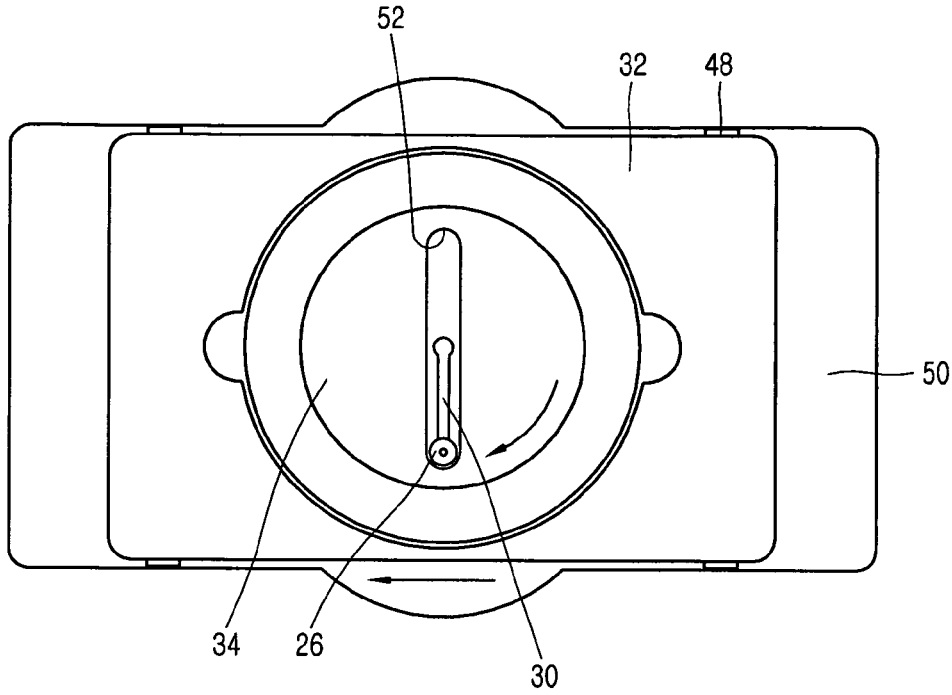
FIGS. 8 to 11 show operational states of the turntable device of the microwave oven in accordance with the present invention.

First, when the first tray 32 is positioned at the center of the cabinet 10, as shown in FIG. 8, the arm 30 is positioned to be level with the slot 52 of the first tray 32 and the first roller 26 is positioned at the front side of the slot 52.

Figure 9:
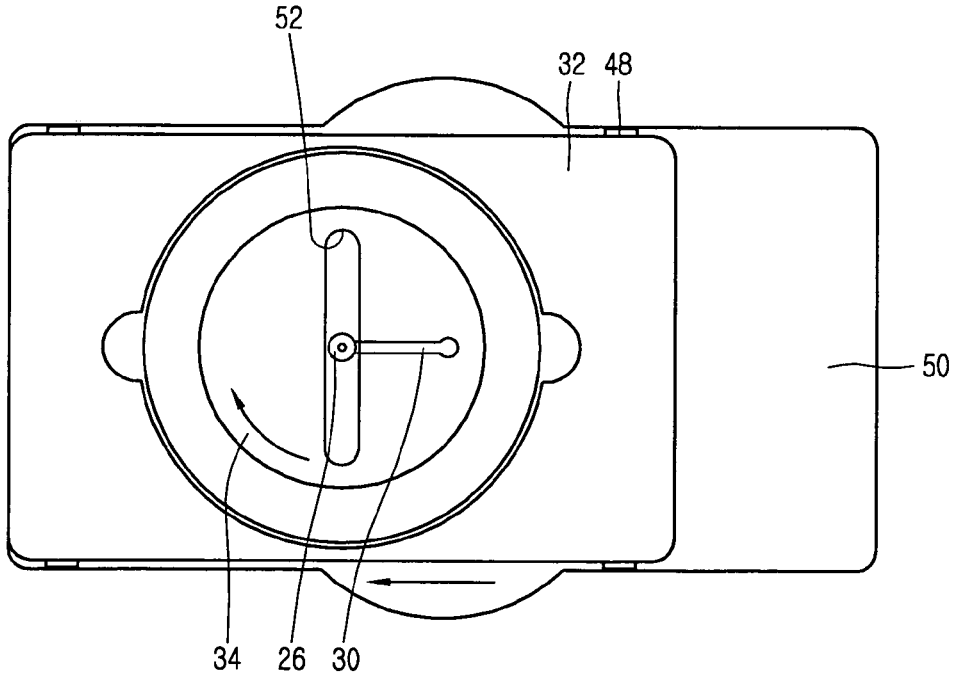

In such a state, when the motor 22 is driven and the arm 30 is rotated, as shown in FIG. 9, the first roller 26 is moved along the slot 52 and the first tray 32 is linearly moved leftwardly at the side of the drawing. At this time, the second roller 28 mounted at the arm 30 is moved along the guide rail 62 of the second tray 34 to rotate the second tray 34. When the first tray 32 is linearly moved leftwardly to its maximum, the first roller 26 is positioned at the center of the slot 52.

Figure 10:
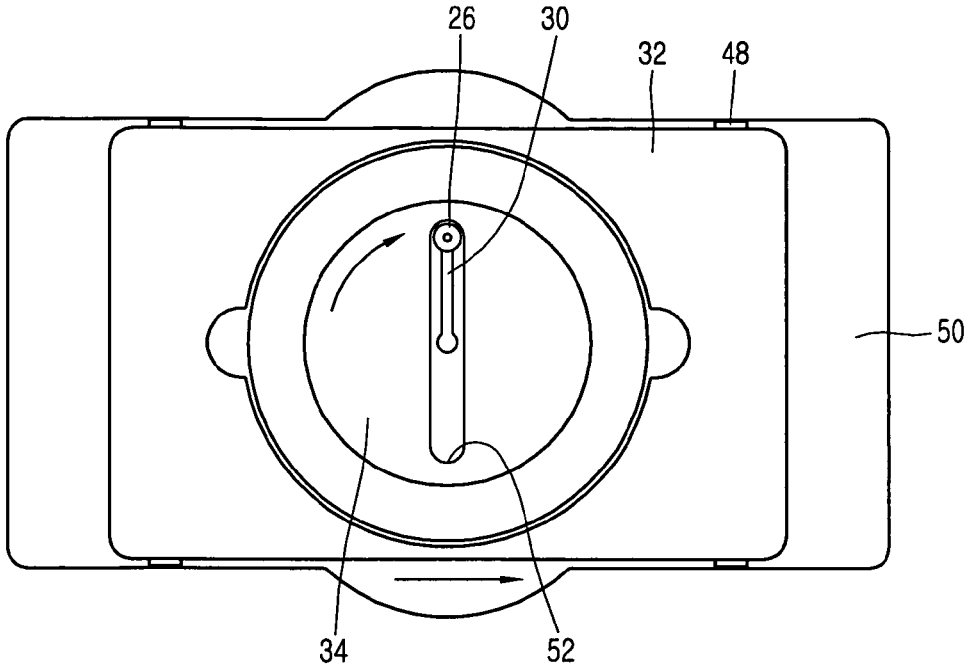

When the arm 30 is further rotated, as shown in FIG. 10, the first roller 26 is moved backwardly from the center of the slot 52, and at this time, the first tray 32 is linearly moved from the left side of the cabinet 10 to the center thereof. When the first tray 32 is positioned at the center, the first roller 26 is positioned at the rear side of the slot 52.

Figure 11:
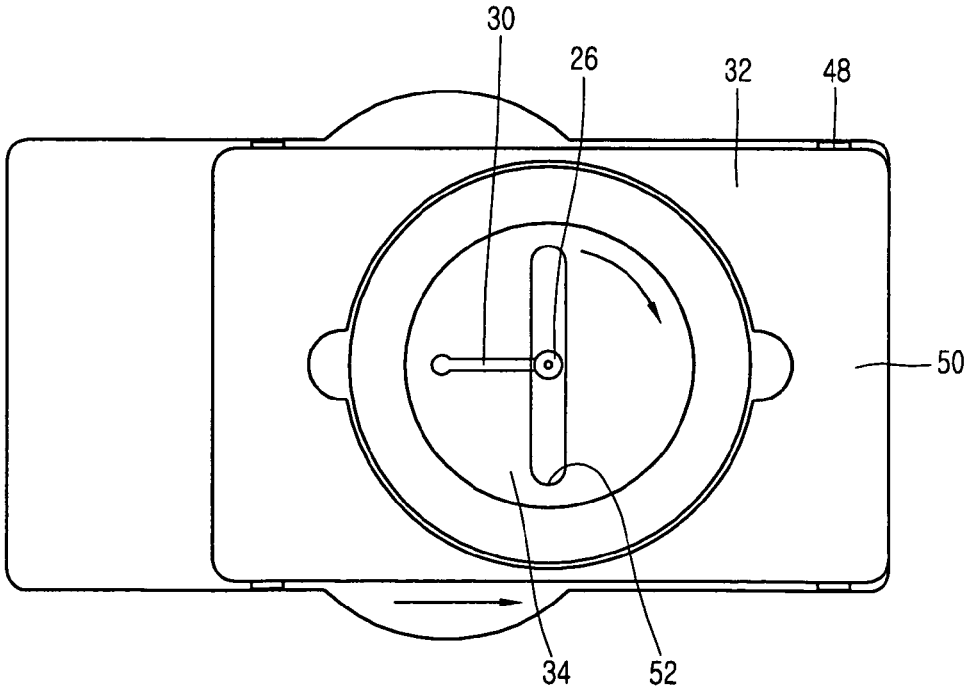

Whet the arm 30 is further rotated, as shown in FIG. 11, the first roller 26 is moved at the slot 52 in the opposite direction, namely, toward the front side of the slot 52, and at this time, the first tray 32 is linearly moved in the rightward direction of the cabinet 10.

In this manner, when the arm 30 is rotated, the first roller 32 is moved from the front side of the slot 52 to the rear side of the slot 52, and then, when the first roller 32 is moved from the rear side to the front side, the first tray 32 is linearly and reciprocally moved in the leftward/rightward directions. At this time, the second roller 28 is inserted in the guide rail 62 of the second tray 34, making the second 34 continuously moved rotatably.

As so far described, the turntable device of the microwave oven in accordance with the present invention has the following advantages.

That is, for example, the first tray is disposed to be linearly and reciprocally moved on the bottom surface of the cabinet and the second tray is rotatably disposed on the upper surface of the first tray, so that when the motor is rotatably moved, the first tray is rotatably moved and at the same time the second tray is also rotatably moved to make a heating target received in the cabinet rotated and linearly and reciprocally moved. Accordingly, the cooking target can be quickly and uniformly heated.

In addition, because the first and second rollers are positioned on the same straight line at the arm, the first roller is inserted to be linearly and reciprocally moved in the slot of the first tray and the second roller is inserted in the guide rail to be linearly and reciprocally moved, a relative velocity difference does not occur between the first and second rollers, and thus, the first and second trays can be prevented from being released.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A turntable device of a microwave oven comprising:

an arm connected with a rotational shaft of the motor so as to be rotatably moved and having fist and second rollers at an end thereof;

a first tray disposed to be linearly moved on the bottom of the cabinet and having a slot into which the first roller is inserted; and a second tray disposed to be rotatable on an upper surface of the first tray and having a guide rail into which the second roller is inserted, wherein the arm is disposed in a space between the first and second trays and includes a first roller support for rotatably supporting the first roller at a lower surface of one end portion the arm, and a second roller support rotatably supporting the second roller at an upper surface of the arm.

2. The device of claim 1, wherein a rotate ring is disposed between the first and second trays in order to rotatably support the second tray.

3. The device of claim 1, wherein the first and second rollers are formed on the same straight line.

4. The device of claim 1, wherein the first tray is formed as a rectangular plate body, a circular mounting part on which the second tray is rotatably disposed is formed on its upper surface, and rollers rollingly moved on the bottom surface of the cabinet is mounted at its lower surface.

5. The device of claim 4, wherein a guide groove is formed on the bottom surface of the cabinet and guides the rollers to be linearly and reciprocally moved.

6. The device of claim 1, wherein the slot of the first tray is formed in a forward/back direction of the microwave oven on the first tray.

7. The device of claim 1, wherein the slot of the first tray has a length twice the length of the arm.

8. The device of claim 1, wherein the second tray is formed as a circular plate body and includes a guide rail in which the second roller is inserted is formed in a radial direction.

9. The device of claim 8, wherein the guide rail of the second tray includes a pair of guide protrusions formed at a lower surface of the second tray and a guide groove formed between the pair of guide protrusions, in which the second roller is inserted.

10. A turntable device of a microwave oven comprising:

a motor mounted at a lower portion of a cabinet;

an arm connected with a rotational shaft of the motor so as to be rotatably moved and having first and second rollers at an end thereof, a first tray disposed to be linearly moved on the bottom of the cabinet and having a slot into which the first roller is inserted; and a second tray disposed to be rotatable on an upper surface of the first tray and having a guide rail into which the second roller is inserted, wherein the second tray is formed as a circular plate body and includes a guide rail in which the second roller is inserted is formed in a radial direction, and wherein the guide rail of the second tray includes a pair of guide protrusions formed at a lower surface of the second tray and a guide groove formed between the pair of guide protrusions, in which the second roller is inserted.

11. A turntable device of a microwave oven comprising:

a motor mounted at a lower portion of a cabinet;

an arm connected with a rotational shaft of the motor so as to be rotatably moved and having first and second rollers rotatably formed at an end thereof;

a first tray disposed to be linearly moved on the bottom of the cabinet and having a slot into which the first roller is inserted; and a second tray disposed to be rotatable on an upper surface of the first tray and having a guide rail into which the second roller is inserted.

12. The device of claim 11, wherein a rotate ring is disposed between the first and second trays in order to rotatably support the second tray.

13. The device of claim 11, wherein the arm is disposed in a space between the first and second trays and includes a first roller support for rotatably supporting the first roller at a lower surface of one end portion thereof and a second roller support rotatably supporting the second roller at an upper surface thereof.

14. The device of claim 11, wherein the first and second rollers are formed on the same straight line.

15. The device of claim 11, wherein the first tray is formed as a rectangular plate body, a circular mounting part on which the second tray is rotatably disposed is formed on its upper surface, and rollers rollingly moved on the bottom surface of the cabinet is mounted at its lower surface.

16. The device of claim 15, wherein a guide groove is formed on the bottom surface of the cabinet and guides the rollers to be linearly and reciprocally moved.

17. The device of claim 11, wherein the slot of the first tray is formed in a forward/back direction of the microwave oven on the first tray.

18. The device of claim 11, wherein the slot of the first tray has a length twice the length of the arm.

19. The device of claim 11, wherein the second tray is formed as a circular plate body and includes a guide rail in which the second roller is inserted is formed in a radial direction.

20. The device of claim 19, wherein the guide rail of the second tray includes a pair of guide protrusions formed at a lower surface of the second tray and a guide groove formed between the pair of guide protrusions, in which the second roller is inserted.

* * * * *